United States Patent [19]

Kelly

[11] 4,034,987

[45] July 12, 1977

[54] GAME WITH GAMEPIECES HAVING POSITION-DENOTING INDICIA THEREON OR THEREUNDER

[76] Inventor: George J. Kelly, 215 Forrest Drive, Sanford, Fla. 32771

[21] Appl. No.: 629,794

[22] Filed: Nov. 7, 1975

Related U.S. Application Data

[63] Continuation of Ser. No. 515,178, Oct. 16, 1974, abandoned.

[51] Int. Cl.[2] ..... A63F 9/00

[52] U.S. Cl. ..... 273/137 R; 273/139

[58] Field of Search ..... 273/130 R, 135 R, 137 R, 273/139, 152 R

[56] References Cited

U.S. PATENT DOCUMENTS

| | | | |
|---|---|---|---|
| 3,420,525 | 1/1969 | Waders | 273/135 R |
| 3,486,753 | 12/1969 | Mansfield | 273/137 R |

OTHER PUBLICATIONS

Kellogg's Fishin Fun — ERASO.

*Primary Examiner*—Anton O. Oechsle

[57] ABSTRACT

Game apparatus for a game of chance comprising a set of gamepieces bearing position-denoting indicia thereon or thereunder, including one winning gamepiece, one or two single gamepieces and the remaining duplicate gamepieces, arranged in a column of two, or, in the case of an odd number of gamepieces, with one single gamepiece, whereby if a specified gamepiece is played first, the winning gamepiece will always be played.

3 Claims, 3 Drawing Figures

GAME WITH GAMEPIECES HAVING POSITION-DENOTING INDICIA THEREON OR THEREUNDER

This is a continuation of application Ser. No. 515,178 filed Oct. 16, 1974, and now abandoned.

This invention relates to a new game. More particularly, this invention relates to a chance controlled game and apparatus means for playing the same.

The game requires certain gamepieces wherein there are a plurality of duplicate gamepieces and at least one single gamepiece and a winning gamepiece. At the beginning of the game the gamepieces are arranged so that the player or players cannot determine any similarities or differences in the gamepieces. The object of the game is to play the gamepieces until the winning gamepiece has been played.

DETAILED DESCRIPTION OF THE INVENTION

Figure 1:
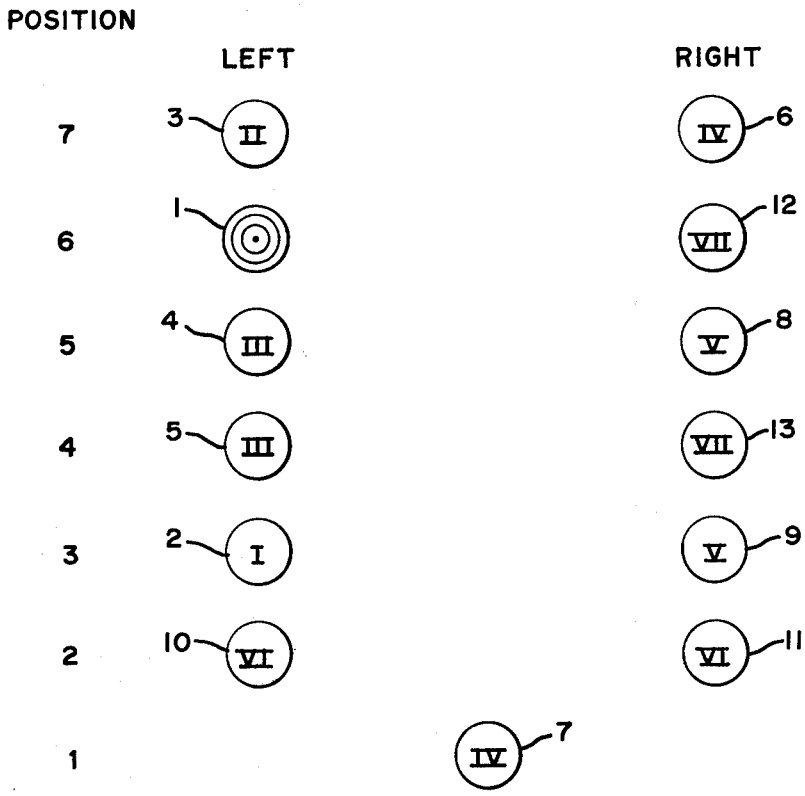
FIG. 1 is a top plan view of an arrangement showing an odd number of gamepieces.

The game will be particularly described with reference to FIG. 1, which shows 13 gamepieces, 1, 2, 3, 4, 5, 6, 7, 8, 9, 10, 11, 12 and 13, each being identically marked or unmarked on one side, which side is facing the player at the start of the game. Each of the gamepieces has indicia on the other side, face down at the start of the game, which indicate certain positions. Gamepiece I has the winning indicia, herein shown as a bullseye, on the back face thereof. Gamepiece 2 has the number I on the backface thereof; gamepiece 3 has the number II on the backface therof; gamepieces 4 and 5 have the number III on the backface thereof; gamepieces 6 and 7 have the number IV on the backface thereof; gamepieces 8 and 9 have the number V on the backface thereof; gamepieces 10 and 11 have the number VI on the backface thereof; and gamepieces 12 and 13 have the number VII on the backface thereof. The gamepieces are randomized before the start of the game and arranged so that there is one gamepiece at an end of a column of two rows of six gamepieces each.

The columns define the gamepieces as having positions 1, left 2, right 2, left 3, right 3, and so forth, the gamepieces nearest to the single gamepiece designated as in position 2, one of which is played first; the single gamepiece is thus in position 1 as shown in FIG. 1.

The game will be further described through play by two players, A and B, playing the game shown as set up in FIG. 1. Although the indicia for each gamepiece is designated in FIG. 1, it will be understood that their identity is unknown to the players in actual play.

After arranging the gamepieces face down, player A overturns one of the gamepieces in position 2, displaying its number. For example, player A, as the first move in the game, overturns the right 2 gamepiece 11 to reveal the number VI. Player B now has a choice of overturning either gamepiece in position 6, and, as the second move, he chooses the right one, gamepiece 12, to reveal the number VII. Player A now, as the third move, chooses a gamepiece in position 7, gamepiece 6, to reveal the number IV.

As the fourth move, player B must overturn a gamepiece in position 4. He chooses gamepiece 5, to reveal the number III. As the fifth move, player A chooses gamepiece 9 in position 3, to reveal the number V. Player B, as the sixth move, chooses gamepiece 4 in position 5 left, to reveal the number III. Player A, as the seventh move, must overturn the remaining unplayed gamepiece in position 3, gamepiece 2, to reveal the number I. As the eighth move, player B must overturn gamepiece 7 to reveal the number IV. Player A, as the ninth move, overturns gamepiece 13 to reveal the number VII. Player B, as the tenth move, overturns gamepiece 3 to reveal the number II. As the eleventh move, player A overturns gamepiece 10 to reveal the number VI. As the final move, player B overturns gamepiece 1 to reveal the bullseye. Player B is now the winner of this game, having overturned the winning gamepiece.

Figure 2:
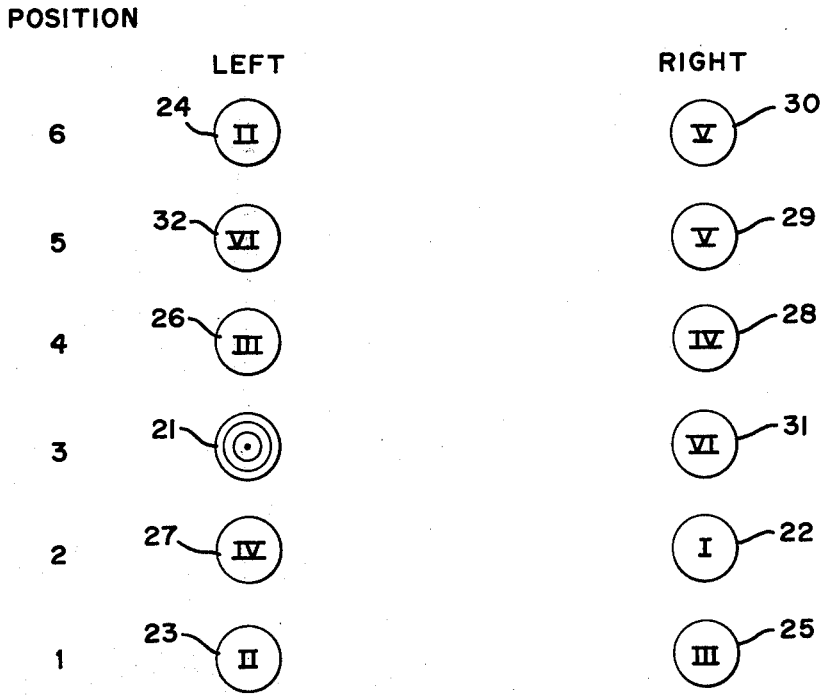
FIG. 2 is a top plan view of an arrangement showing an even number of gamepieces.

The game can also be played with an even number of gamepieces, as shown in FIG. 2. In this game, the gamepieces are arranged in two columns, shown as gamepieces 21, 22, 23, 24, 25, 26, 27, 28, 29, 30, 31 and 32. One of the gamepieces in position 1 is always played first in this arrangement.

To illustrate play of this game, player A, as the first move, overturns one of the gamepieces in position 1, gamepiece 25, to reveal the number III. Player B, as the second move, overturns the right position 3 gamepiece 31, to reveal the number VI. Player A, as the third move, overturns gamepiece 30 to reveal the number V. Player B, as the fourth move, overturns gamepiece 32 to reveal the number VI. Player A now must choose gamepiece 24 to reveal the number II. Player B, as the sixth move, overturns gamepiece 27 to reveal the number IV. Player A, as the seventh move, overturns gamepiece 26 to reveal a III. Player B, as the final move, must choose gamepiece 21 to reveal the bullseye.

Although the gamepieces in FIGS. 1 and 2 are shown as discs having Roman numerals on one side, it will be apparent that the gamepieces can be of any shape or size, so that facedown they are indistinguishable from each other, such as plastic discs, squares, cards and the like, and, in place of Roman numerals, other designations of pairs and singles can be employed, such as colors, figures, shapes, names and the like and so that the position corresponding to that indicia is known or decided upon before the game begins. A supplementary game board can be used to identify the various positions for example.

Further, although the Figures show a certain number of gamepieces, other numbers of gamepieces can be used. For an odd number of gamepieces, one gamepiece will be the winning gamepiece, there will be two other and different single gamepieces and the remaining gamepieces will be sets of duplicate gamepieces. When there are an even number of gamepieces, there will be the winning gamepiece and another single gamepiece and the remaining gamepieces will be sets of duplicate gamepieces.

Figure 3:
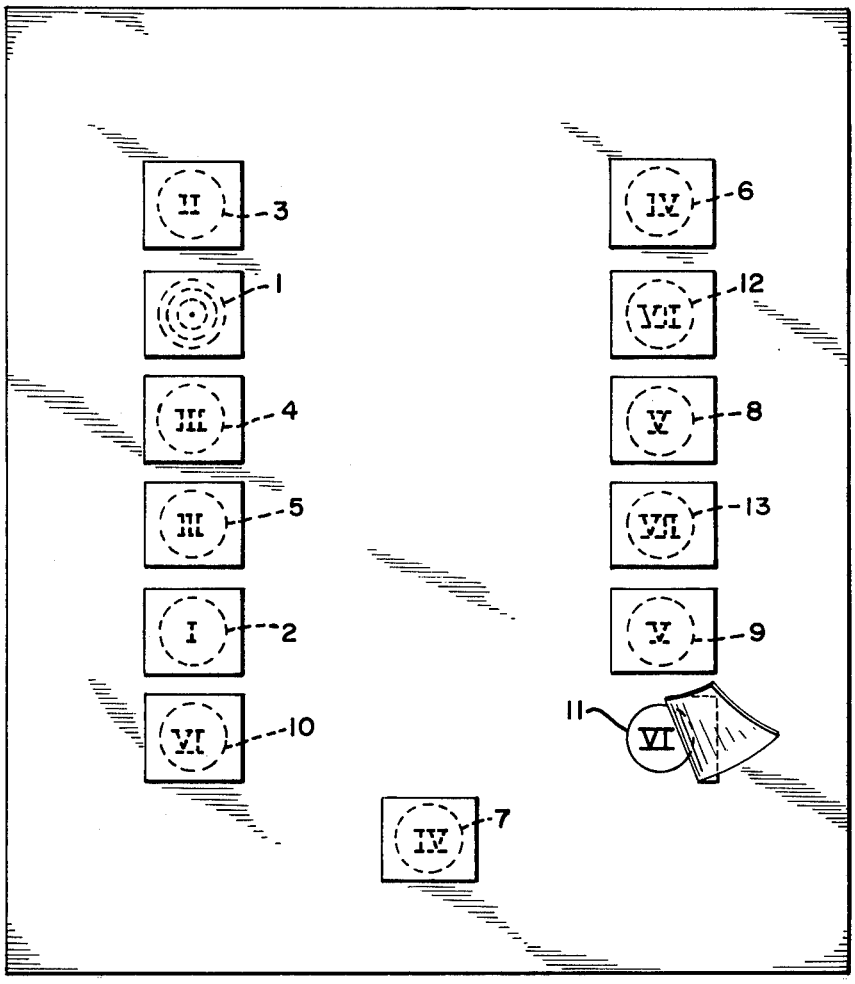
FIG. 3 is a top plan view of the odd number of gamepieces of FIG. 1 arranged on a playing sheet having removeable tabs.

Although the game has been described hereinabove in the form of gamepieces alone, the game can also be played on cards or sheets printed with indicia in an appropriate arrangement having readily removable means, such as tabs, thereon as shown in FIG. 3. For example, a computer can be programmed so as to randomize the position of numbers in the appropriate arrangement for even or odd sets of indicia to play the game, and the numbers on print-out sheets would be covered over by removable adherent tabs or tapes. The game would be initiated by pulling of a tab in the starting position to reveal the position-denoting indicia beneath, and so forth.

By beginning the game in the correct position, at position 2 for an odd number of gamepieces and in position 1 for an even number of gamepieces, the winning gamepiece will always be played, so that every game can be completed. This is particularly advantageous when only one player plays the game, unlike other games designed for a single player.

The game can be played by one and up to several players using one or more sets of gamepieces. Two or more players can play with one set of gamepieces, or each player with a separate set of gamepieces, competing against each other as to which player can complete a game in the shortest period of time, or using the lowest or highest number of moves and the like. Alternatively, two or more players, each playing with separate sets of gamepieces, randomly arranged, can play in sequence, as, if the first player starts in the starting position and overturns a position 3 gamepiece, the next player must overturn a position 3 gamepiece in his set and so forth until a winning gamepiece is revealed. Many other variations of the game will be apparent and are meant to be included herein.

From the foregoing, it will be seen that the game to be played is played in the following sequence: a player randomly shuffles or arranges the gamepieces, so that their value is unknown, in two columns for an even number of gamepieces and in two columns having a single gamepiece in position 1 for an odd number of gamepieces, starting play at position 1 for an even number of gamepieces and in position 2 for an odd number of gamepieces, as shown hereinabove; determining the next position to be played and continuing until the winning gamepieces has been chosen. The foregoing permits an interesting and amusing game to be played by one or more players. Many variations of the game are possible and each variation is interesting and entertaining.

I claim:

1. A method of playing a game which comprises 1. providing a set of gamepieces having position-denoting indicia on one side and being blank on the other side, said set comprising an odd number of gamepieces including a winning gamepiece, a plurality of duplicate gamepieces numbered (3) and upwards and two single gamepieces numbered (1) and (2), and arranging said gamepieces respectively randomly in two columns such that the indicia are not revealed, and such that the odd gamepiece is arranged singly at an end of the columns in the position regarded as the number (1) position, the position in each column being regarded as sequentially numbered beginning with the number (2) in relation to their succeeding remoteness from the number (1) position, said indicia directing the player to the next position where he can choose to overturn a piece that has not been overturned in either of the columns,
2. revealing first the indicia of either of the two gamepieces in position (2), thereby directing the player to overturn a gamepiece in the next position as designated, and
3. revealing succesively the remaining gamepieces in the order of the position indicated by the revealed indicia until the winning gamepiece is played.

2. A method of playing a game which comprises 1. providing a set of gamepieces having position-denoting indicia on one side and being blank on the other side, said set comprising an even number of gamepieces including a winning gamepiece, a plurality of duplicate gamepieces numbered (2) and upwards and a single gamepiece numbered (1), and arranging said pieces randomly in two columns such that the indicia are not revealed, the positions in each column being regarded as sequentially numbered from one end thereof beginning with the number (1), said indicia directing the player to the next position where he can choose to overturn a piece that has not been overturned in either of the columns,
2. revealing an indicia of one of the pieces at said one end of the column thereby directing the player to overturn a gamepiece in the next position as designated, and
3. revealing successively the remaining gamepieces in the order of the position indicated by the revealed indicia until the winning gamepiece is played.

3. A game of chance comprising a playing sheet having 12 numbers and a bullseye arranged randomly in a double column and a single number or bullseye for a position at an end of the column regarded as the number (1) position, the position in each column being regarded as sequentially numbered beginning with the number (2) depending on their succeeding remoteness from the number (1) position, the numbers including two single numbers, namely (1) and (2), and five duplicate numbers, namely numbers (3),(4),(5),(6) and (7), and removeable tabs covering said numbers and bullseye whereby a tab at either of the number (2) positions is removed thereby revealing a number designating the next position to be played and in succession the remaining tabs are removed as designated until the bullseye is revealed.

* * * * *